US005405239A

United States Patent [19]

Calzolari et al.

[11] Patent Number: 5,405,239

[45] Date of Patent: Apr. 11, 1995

[54] METHOD AND EQUIPMENT FOR THE FEEDING OF PRE-FORMED BOXES TO A MACHINE, FOR EXAMPLE TO A BOX-FILLING MACHINE

[75] Inventors: Guiseppe Calzolari, San Lazzaro Di Savena; Ettore Carati, Castel San Pietro; obici Valter, Ponticelli, all of Italy

[73] Assignee: Cefla Soc. Cooop. A.R.L., Italy

[21] Appl. No.: 883,121

[22] Filed: May 14, 1992

[30] Foreign Application Priority Data

Jun. 4, 1991 [IT] Italy ..... BO91A0194
Feb. 28, 1992 [IT] Italy ..... GE92A0019

[51] Int. Cl.[6] ..... B65G 59/00
[52] U.S. Cl. ..... 414/788.4; 198/803.8
[58] Field of Search ..... 414/788.3, 788.4, 790.2, 414/790, 792.2; 198/803.8; 271/34, 31.1, 271; 474/134, 135; 493/125, 126, 179

[56] References Cited

U.S. PATENT DOCUMENTS 2,624,576 1/1953 Lauffer ..... 271/12
2,941,676 6/1960 Harker ..... 198/803.8
4,049,258 9/1977 Zeblisky ..... 414/788.4
4,361,318 11/1982 Stobb ..... 271/215
4,656,815 4/1987 Jaton ..... 53/244
5,033,995 4/1991 Salesse ..... 475/182

*Primary Examiner*—David H. Bollinger
*Attorney, Agent, or Firm*—Larson and Taylor

[57] ABSTRACT

The boxes are stacked in a station from which they are collected singly by suitable devices and transferred to a conveyor which carries them to the feed store of the box-filling machine, where they are released singly at a frequency such that the load level of the store remains within values which permit reliable operation of the devices which extract the boxes from the bottom of the store and insert them into the box-filling machine. The conveyor comprises equally spaced grippers consisting of strip springs bent longitudinally in the form of a bow and positioned with the concave part facing the belt of the conveyor to which they are fixed by their intermediate part with a clearance, both rounded ends of the strips normally being in contact with the belt. In the phase of collection and release of the boxes, the strips travel around small diameter pulleys, so that the bending of the strips decreases, facilitating the insertion of the boxes between the strips and the belt and their extraction therefrom.

19 Claims, 10 Drawing Sheets

S
B
B1
147
247
47
T

METHOD AND EQUIPMENT FOR THE FEEDING OF PRE-FORMED BOXES TO A MACHINE, FOR EXAMPLE TO A BOX-FILLING MACHINE

Machines designed to introduce an article into a box, so-called box-filling machines, are usually provided with a store in which said boxes, flattened and stacked as they arrive from the cardboard manufacturing process, are disposed in a stack, while beneath said store means are arranged for operation in phase with the box-filling machine to pick up a box and introduce it into a compartment of said box-filling machine. The operation of said last-mentioned means may be adversely affected by a variation in the number and, therefore, in the pressure of the boxes in the feed store. The replenishment of the store of the box-filling machine is currently assigned to a person who inserts small packs of boxes into the store cyclically and, therefore, the correct operation of the box-filling machine depends at present on the experience and sensitivity of this person. How anachronistic and irrational this procedure is, becomes evident in view of the highly advanced automation of the present technology and the very high output rates of the latest generation of box-filling machines.

An object of the invention is the automation of the resupply of boxes into the store of the box-filling machine, so as to make the process extremely certain, reliable, automatic and independent of the presence of skilled personnel. Another object of the invention consists of the resupply of boxes to the store of the box-filling machine by automatic means permitting the use of packages containing the stacks of boxes produced by the cardboard manufacturing process, even in a remote location separate from that where the box-filling machine operates, thus avoiding any contamination of the latter location which, especially in the processing of pharmaceutical products, must be kept in a substantially sterile condition.

According to the invention, the stacks of boxes are arranged in a principal pre-feed station or store from which suitable means pick up one box at a time, i.e. singly, and transfer it to at least one motorized conveyor of any suitable type, disposed so as to hold the boxes and carry them is single file without damaging them at all. If the boxes are to be fed to a box-filling machine which processes pharmaceutical products and operates in a sterile environment, said means are arranged, preferably, in a machine room which is isolated from said sterile environment. The conveyor which carries the boxes after each other in succession passes through an aperture in a wall of the machine room and enters the sterile environment near the store of the box-filling machine, containing a pre-established minimum quantity of boxes, where it releases the boxes singly at a frequency related to the operating rate of the box-filling machine and, anyway, such that the load of the boxes in the feed store is kept substantially constant. More particularly, the arrangement may be such that whenever each box is withdrawn from the store of the box-filling machine another box is released into the top of said store by said conveyor.

If a box is not transferred to the conveyor due to incorrect operation of the means collecting the boxes from the principal pre-feeding store, said conveyor will adjust its own speed to meet said replenishment requirements of the feed store for the box-filling machine which anyway constitutes, with the boxes therein, a buffer storage ensuring the operative continuity of the box-filling machine.

Should a box fail to be inserted into the feed conveyor and fall just after leaving the principal pre-feeding store, means such as jets of air could be activated automatically to remove the fallen box and avoid any jamming in the primary feed system.

Finally, should a box fail to be inserted correctly into the feed conveyor, or should it have a manufacturing defect, whereby the correct transfer of the box into the store of the box-filling machine or the operation of said box-filling machine is adversely affected, means could be activated to remove such boxes from the conveyor before they enter the store of the box-filling machine.

It is easy to realize the importance of the method according to the invention, with the collection of the boxes singly from a pre-feed station separate from the box-filling machine and the transfer of the boxes to a conveyor which automatically releases said boxes singly into the feed store of the box-filling machine, at a frequency which is directly proportional to the operating frequency of the box-filling machine, so that said store is always in the optimum load condition.

The present invention relates further to a conveyor provided with holding grippers which is of simple construction and of high reliability for the purposes in question.

Also, the invention is directed to the particular solution used to automatically insert the boxes singly into said conveyor.

These and other characteristics of the invention, and the advantages resulting therefrom, will become apparent from the following description of a preferred embodiment thereof, shown merely as a non-limiting example in the Figures of the accompanying drawings, in which.

Figure 1:
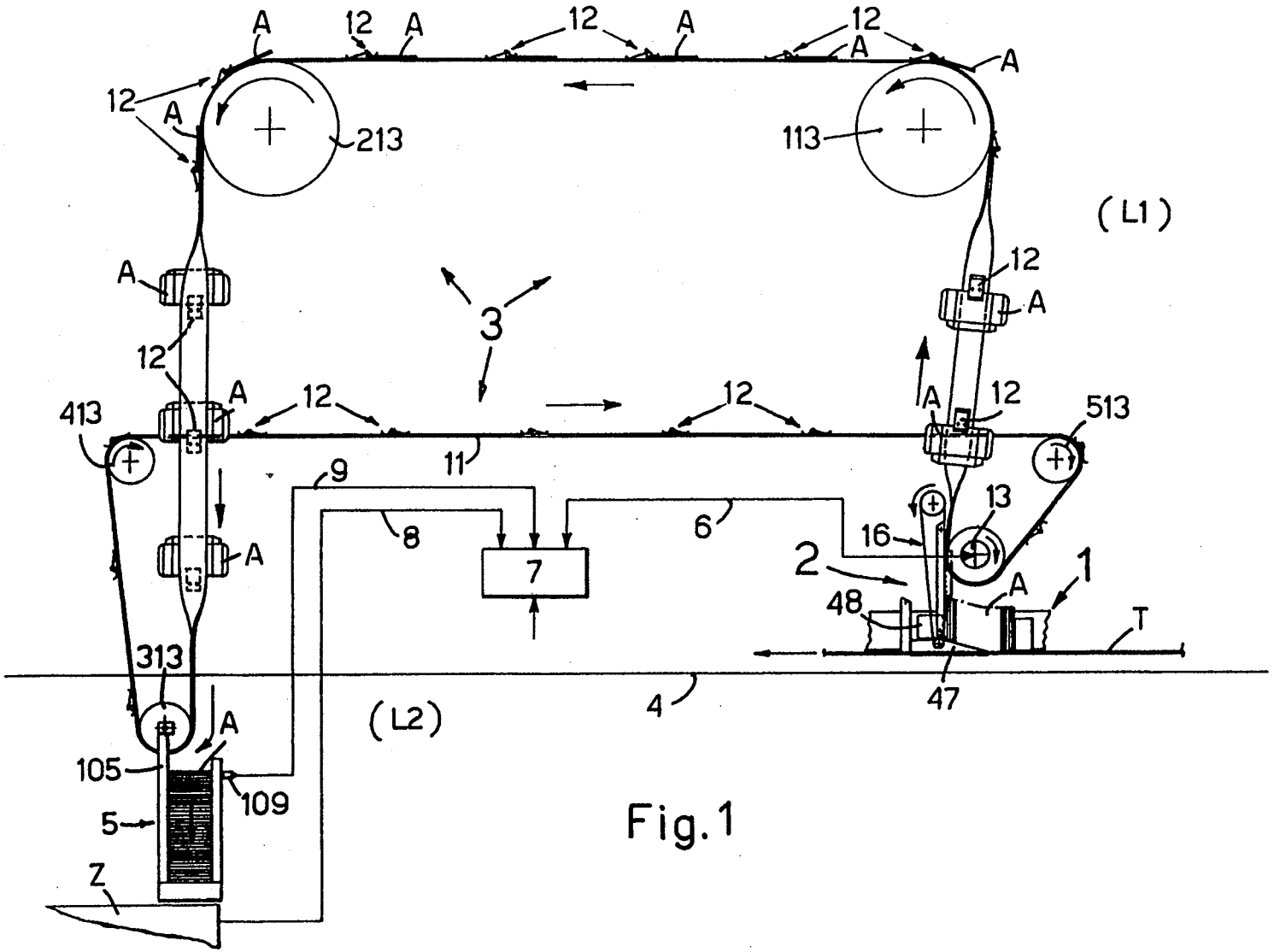
FIG. 1 is a schematic side elevational view of the equipment according to the invention.

In FIG. 1, 1 indicates a station of any suitable type in which are arranged the stacks of boxes A picked up from a package coming from the cardboard manufacturing process. Means 2 of any suitable type, to be discussed below, pick up a box cyclically from the pre-feed station 1 and transfer it to any suitable conveyor 3 which is pre-arranged to support the boxes in single file, to hold them correctly disposed and orientated and without damaging them. The station 1, means 2 and conveyor 3 may be located, if desired, at a position L1 separate from the position L2 where the box-filling machine operates as shown, for example, by the dividing wall 4. The conveyor 3 passes through an opening in the dividing wall 4 and reaches the store 5 of the box-filling machine Z, to release a box cyclically into the top portion of said store. The common motor drive of the means 2 and conveyor 3 is connected as indicated at 6 to a control logic 7 which, through connections 8 and/or 9, detects the speed of operation of the box-filling machine and, if necessary, detects, through a sensor 109, the load level of the store 5, to match the speed of the means 2 and 3 to that of the box-filling machine and to make the load level of the store 5 remain substantially constant or, at least, within limits ensuring an optimal operation of the means picking up the boxes from said store and inserting them into the box-filling machine.

The pre-formed boxes A are, for example, stacked horizontally within cases S having front openings B and are advanced after each other by a horizontal sliding conveyor T and/or by gravity, so that the boxes will abut against said pre-feed means 2 which cyclically pick up the leading box in the case S and withdraw it from said case, while the other boxes are restrained against any undesired displacement. The means 2 for pre-feeding the boxes derive their motion, preferably, from the conveyor 3 through a suitable mechanism for phased connection, to be described below, which generates a variable motion and which is capable of correctly transferring said boxes to the conveyor 3.

The conveyor 3 comprises a toothed belt 11, made of teflon with a core of steel wires, on whose outer face, which may be either smooth or slightly rough, there are fixed at equal intervals grippers 12 to which a box A picked up from the station 1 is transferred by the pre-feeding means 2. If the conveyor 3 has to follow a composite path, as shown merely indicatively in FIG. 1, with return around the pulleys 13-113-213-313-413-513, certain sections of said conveyor will exhibit a helical displacement of the belt 11, which is necessary to prevent the grippers from interfering with said return pulleys.

Figure 2:
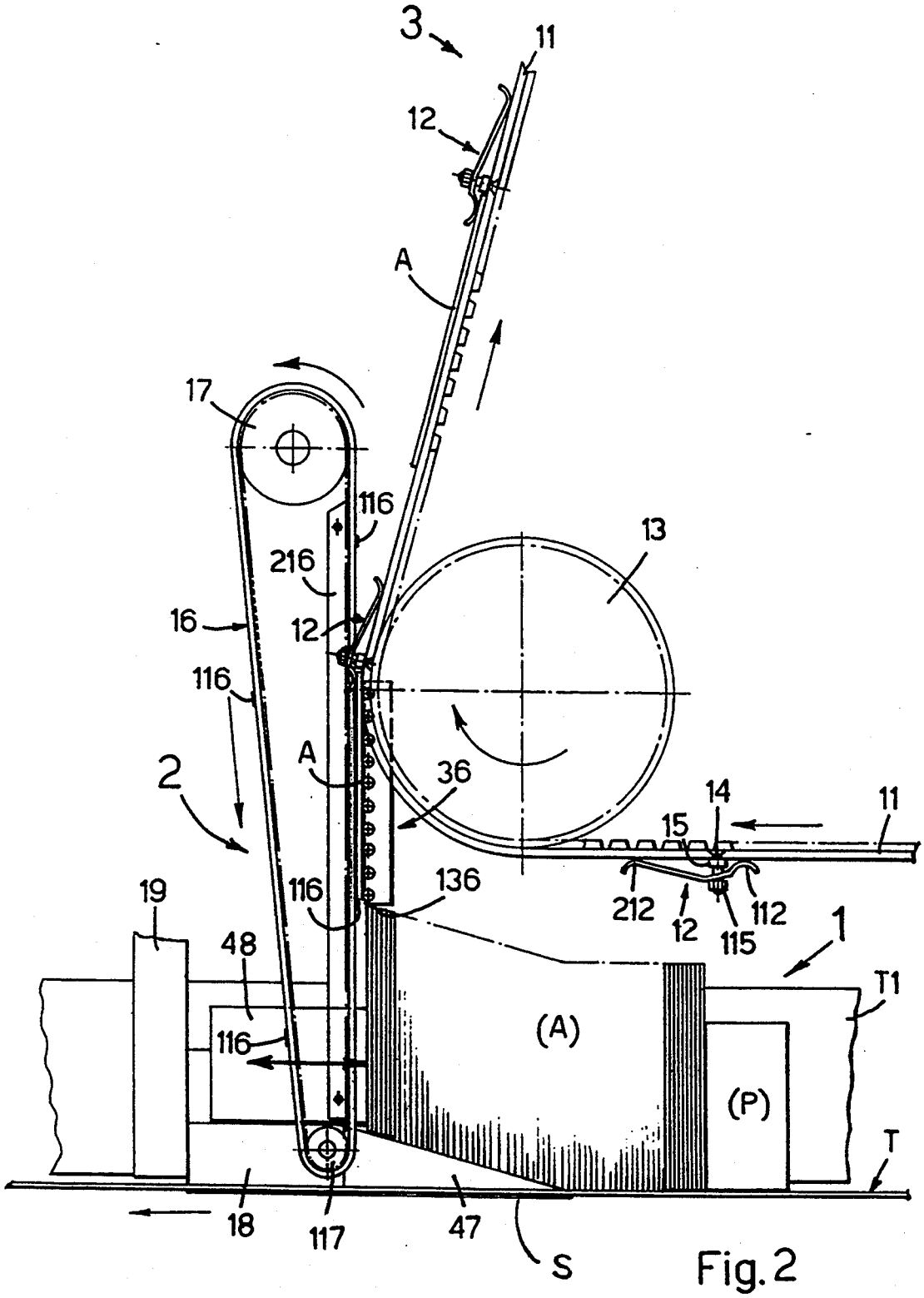
FIG. 2 is an enlarged side elevational view of the conveyor for holding and transferring the boxes, in the section where it co-operates with the means which insert the boxes in phase into said conveyor.

As shown in FIG. 2, the grippers 12 consist of a bow-shaped strip of either spring steel or stainless steel, orientated with its larger dimension in the direction of the length of the belt, with its concave part facing the belt and having both ends 112-212 suitably rounded, for example, by bending said strip. The gripper 12 thus formed is provided intermediately with two transversely aligned holes which are penetrated, with sufficient clearance, by the shanks of respective rivets or screws 14 whose flat heads are accommodated in corresponding seats in the toothed face of the belt. A small nut 15 secures the screws to the belt and a cap nut 115 retains the strip 12 on said screws. Preferably, the length of the section of strip 12 included between the fixing screws 14 and the end 112 and orientated rearwards with respect to the direction of movement of the belt 11, is much smaller than that of the opposite leading section.

The shape and dimensions of the strip forming the grippers 12 are such that when the strip passes along the rectilinear sections of the belt 11 or around circumferences of sufficiently large diameter, e.g. those of the pulleys 113-213, the strip is held in a sufficiently compressed condition by the engagement of its intermediate part with the retaining nuts 115 and by the engagement of its ends 112-212 with the belt 11. Conversely, when the strip 12 travels around circumferences of small diameter, such as those of the pulleys 13 (and 313), said strip 12 is subjected to a low bending stress, so that the means 2, which operate in phase with the conveyor 3, can easily insert the edge of a box A between the end 112 of said strip and the belt 11. The pulley 13 is located at the principal pre-feed station 1, where the cyclic feed means 2 operate and insert a box A in phase under the end 112 of the strips 12 when the latter travel around said pulley 13. Preferably, the insertion of a box under the strips 12 should take place shortly before said strips leave the pulley 13, so that when a box is released from the means 2 the strip 12 has commenced its rectilinear travel and is conveniently compressed to retain the box. It is evident that, both in the step of introduction under the strip 12 and in the conveying step, the box is handled gently and is not deformed at all, this being also due to the small engagement surface with the holding means 11-12.

When a box carried by the conveyor 3 reaches the store 5 of the box-filling machine, the strip 12 which retains said box travels around the small-diameter pulley 313 which repeats the situation discussed above in the loading step. While traveling around this pulley, the bending stress on the strip 12 decreases, so that when the front edge of the box becomes engaged with the stops 105 which are disposed laterally to the belt 11 and which, for example, form a part of the guide columns of the store 5, the box leaves the strip 12 and falls into the last-mentioned store in the correct stacking position on the underlying boxes.

Figure 3:
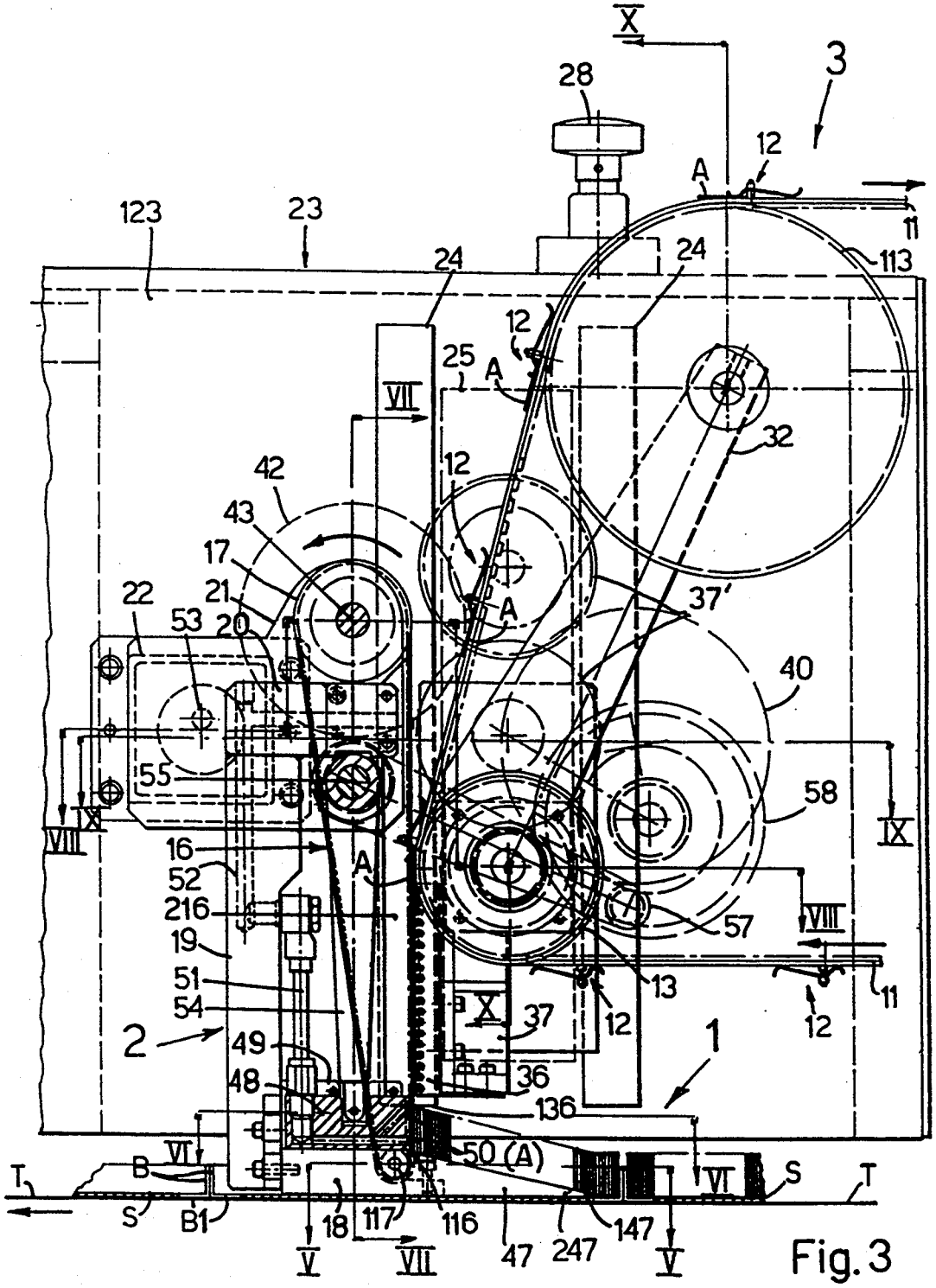
FIG. 3 is a side elevational and partly sectional view of the means for singly inserting the boxes cyclically and in phase into the holding and transferring conveyor.
Figure 8:
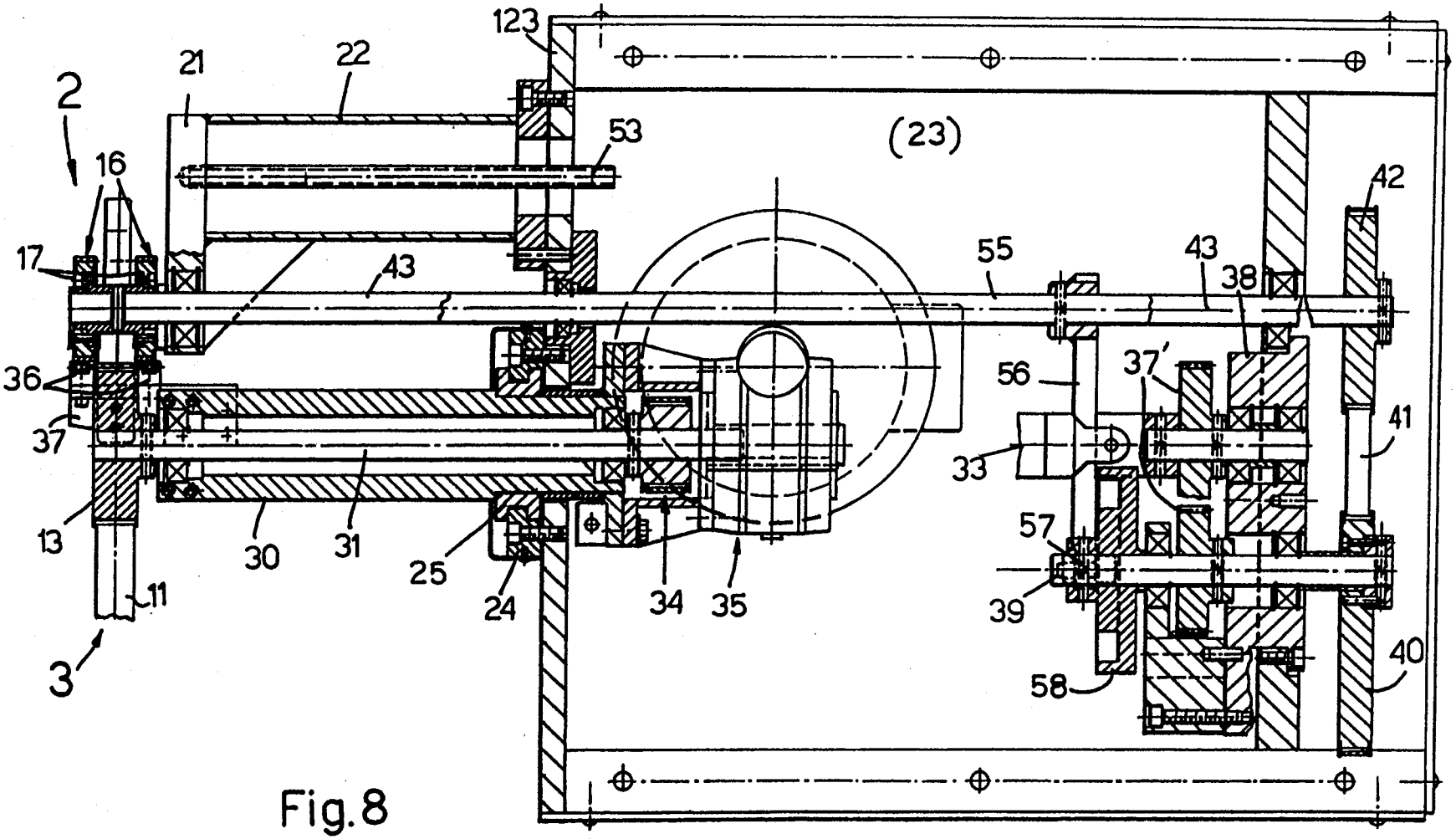
Figure 10:
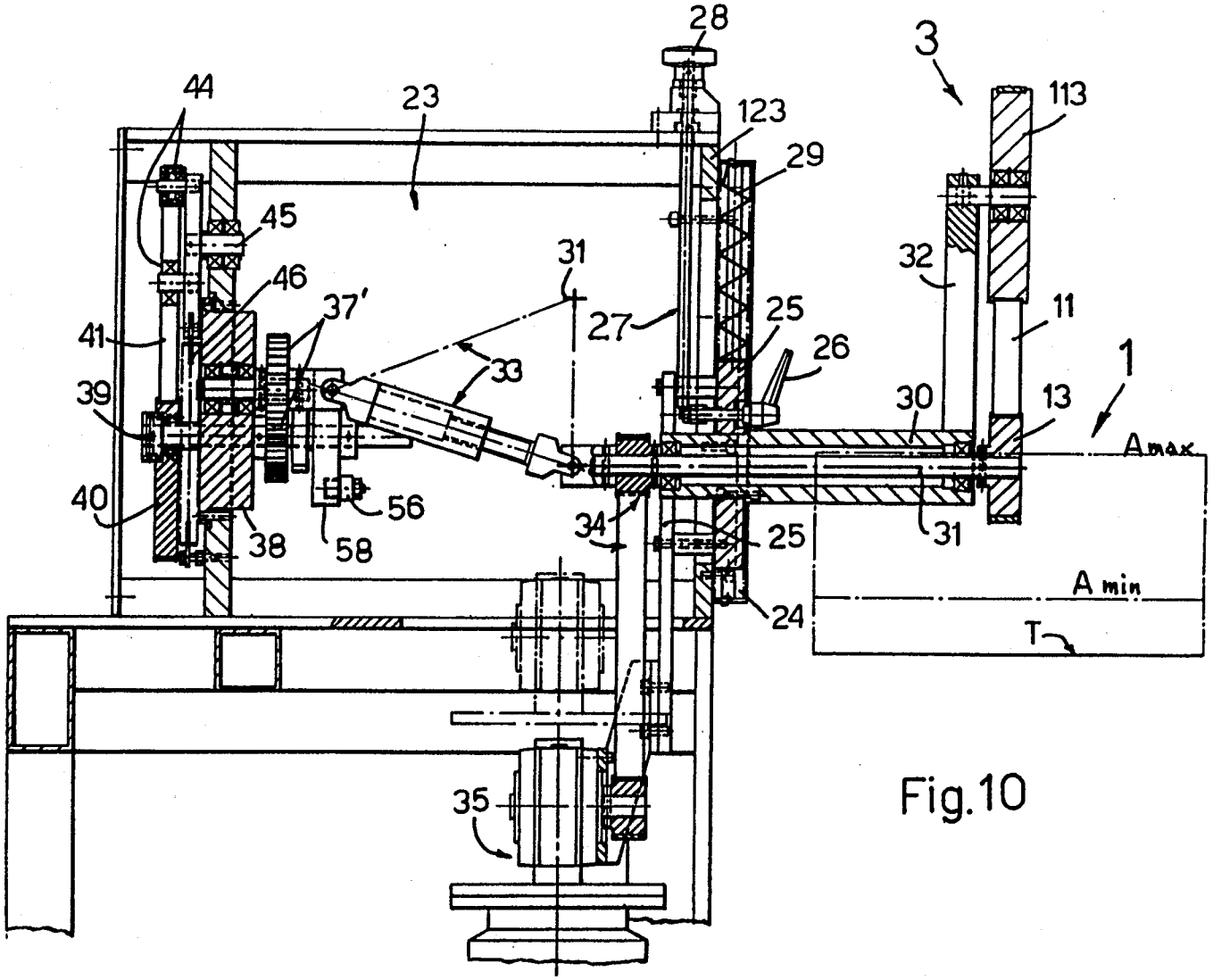
Figure 11:
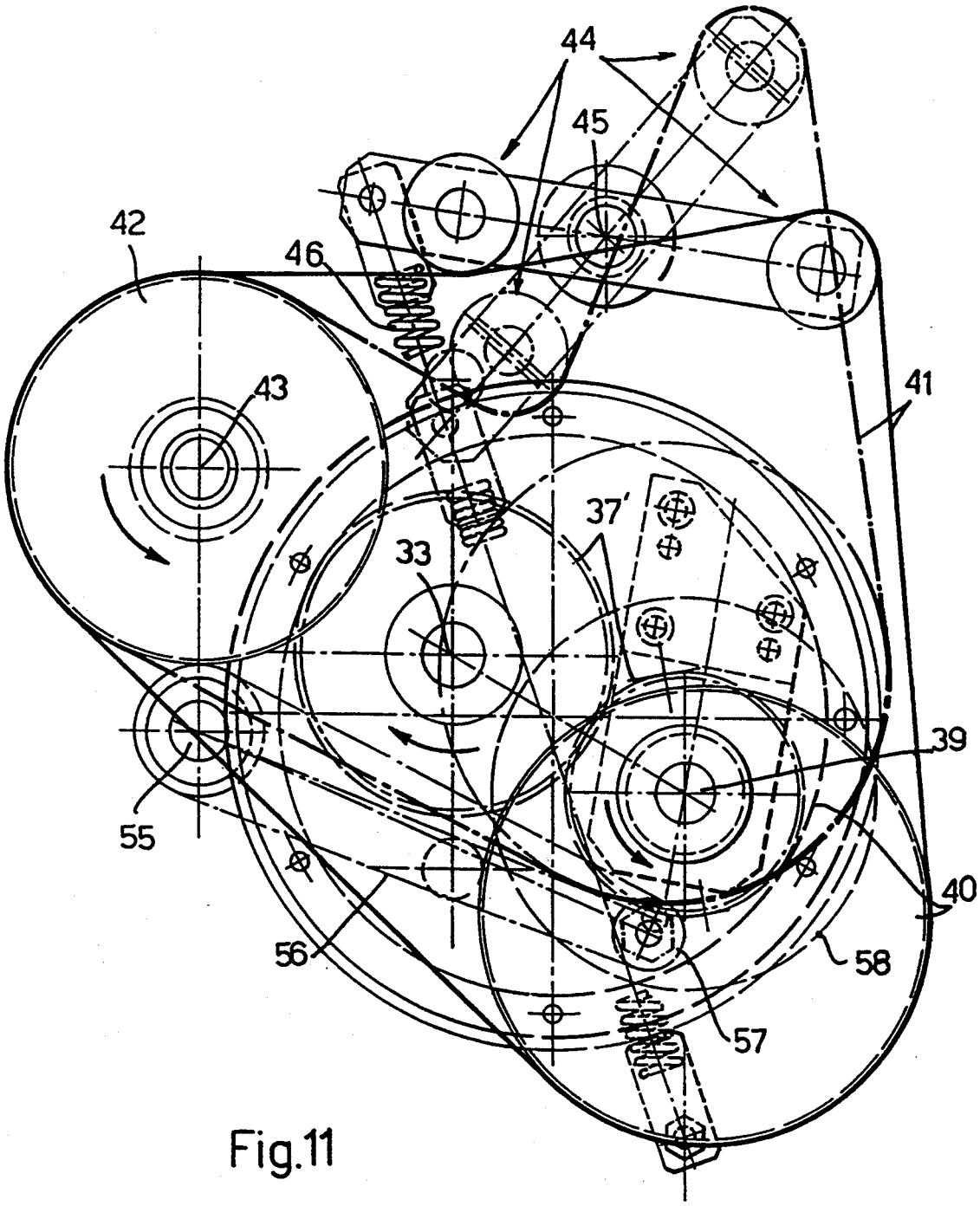
FIG. 11 is a front elevational view of the means for transmitting the variable motion to the means for singly inserting the boxes cyclically and in phase into the holding and transferring conveyor.

The pre-feeding station 1 may be constructed and fed in any suitable manner, for example as described herein with reference to FIGS. 1 and 3. Boxes A are arranged, for example, as horizontal stacks within cases S each having a front opening B and advanced after each other by a sliding conveyor T and/or by gravity, whereby said boxes will be stopped by the vertical, co-planar and guided flights of a pair of parallel toothed pick-up belts 16 which are suitably spaced apart and mounted around toothed pulleys 17-117, the upper pulleys having a larger diameter than the lower ones and being the driving pulleys. The lower pulleys 117 are supported laterally by a shoe 18 which is suitably raised with respect to the conveyor T, extending for a suitable length in the direction of advance of said conveyor and which is secured to the lower end of a supporting upright 19 which, in turn, is secured at the upper end thereof to a T-shaped support 20 secured in cantilever fashion to a plate 21. The plate 21 is arranged edgewise and is secured to the end of a tubular support 22 which, in turn, is secured in cantilever fashion to the side frame 123 of a casing 23 accommodating both the motor actuating the conveyor 3 and the mechanism connecting it to the pre-feeding means 2. It can be seen in FIGS. 3-8-10 that the side frame 123 comprises a vertical guide 24 for sliding movement of a slide 25 whose vertical position can be varied by acting on the clamping/releasing means 26 and on the screw-and-nut control 27 provided with a handwheel 28. A spring 29 usually urges the slide 25 downwards. The slide 25 supports in cantilever fashion a horizontal sleeve 30 which, with the intermediary of bearings, rotatably supports therethrough a co-axial shaft 31 having the pulley 13 of the conveyor 3 keyed to an end thereof. The adjacent pulley 113 of said conveyor 3 is rotatably supported by an arm 32 secured to said sleeve 30. The other end of the shaft 31 is connected to a universal joint 33 and is also connected, through a positive drive of the pulley-and-toothed type belt 34, to a variator gearmotor 35 secured to the slide 25. In case of variation of the height of the boxes A in the station 1, the handwheel 28 is acted upon to adjust the vertical positioning, i.e. the distance, from the conveyor T, of the pulley 13 of the conveyor 3 and elements associated therewith comprising, inter alia, a pair of vertical roller tracks 36 which are opposite to a portion of the vertical active flight of said pick-up belts 16 and secured to a support 37 connected to the sleeve 30 (FIG. 8).

It can be seen in FIGS. 3-8-10-11 that the universal joint 33 imparts a rotation to a geared speed multiplier 37' sustained by a removable support 38 and whose output shaft 39 has keyed thereto eccentrically a toothed pulley 40 which, by means of a toothed belt 41, drives the toothed pulley 42 which is keyed to a shaft 43 having keyed thereto the upper pulleys 17 of the prefeeding belts 16. A double jockey pulley device 44, swingable on the shaft 45 and urged by a spring 46', keeps the belt 41 taut constantly. The mechanism 40-41-42-43-44-45-46 transfers to the belts 16 a movement which is in phase with that of the conveyor 3 and which comprises accelerations and decelerations which are required to cause said belts to insert a box A cyclically under a gripping strip 12, and then to slow down and permit said boxes supported by the grippers 12 to be removed.

Figure 4:
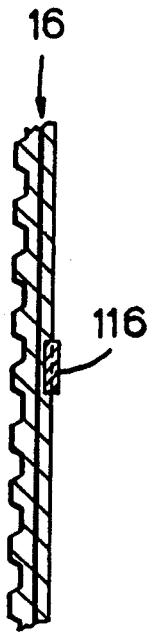
FIG. 4 is an enlarged side elevational view of a portion of a skimming belt which operates in the device of FIG. 3.
Figure 5:
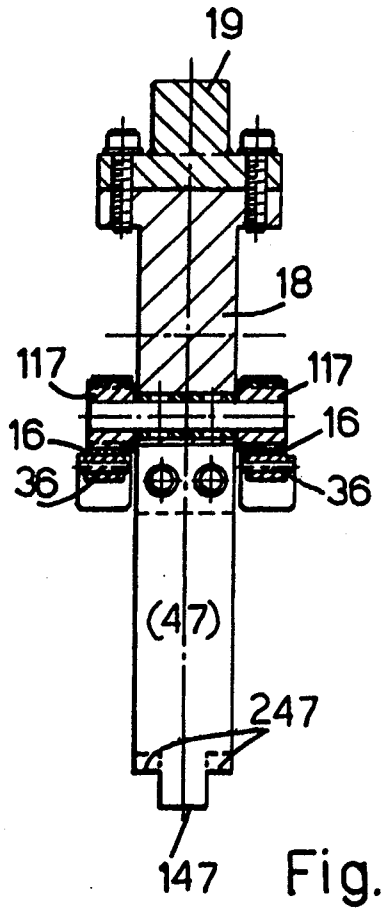
FIGS. 5-6-7-8-9-10 show as many details of the means of FIG. 3, in sectional view on the lines V—V, VI—VI, VII—VII, VIII—VIII, IX—IX and X—X, respectively, of FIG. 3.
Figure 6:
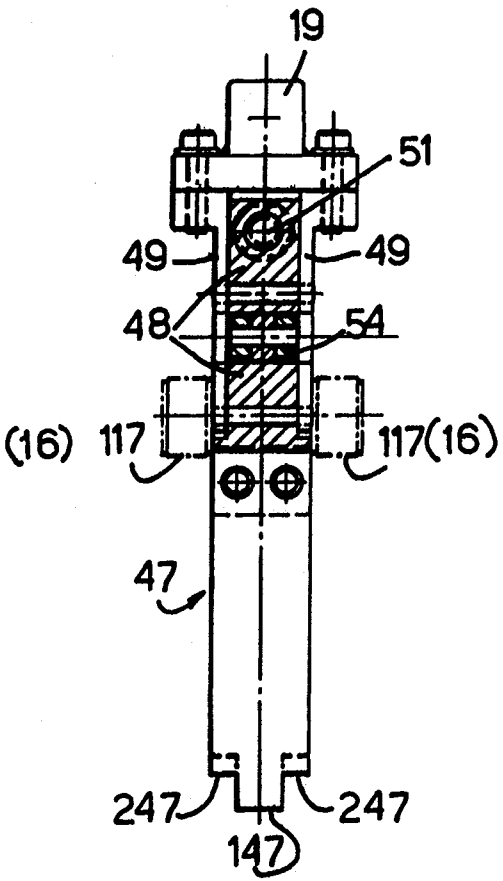
Figure 9:
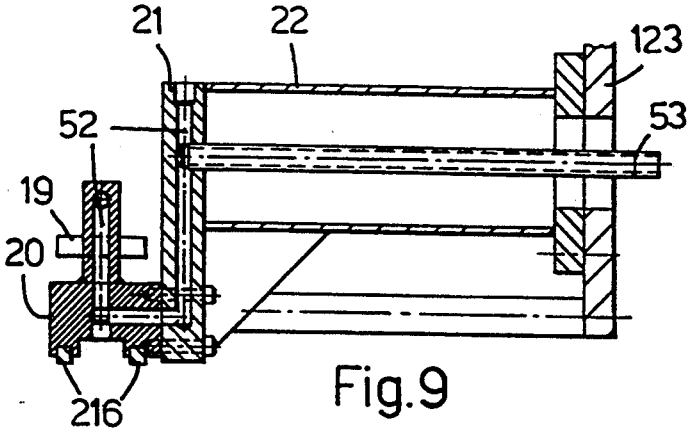
Figure 7:
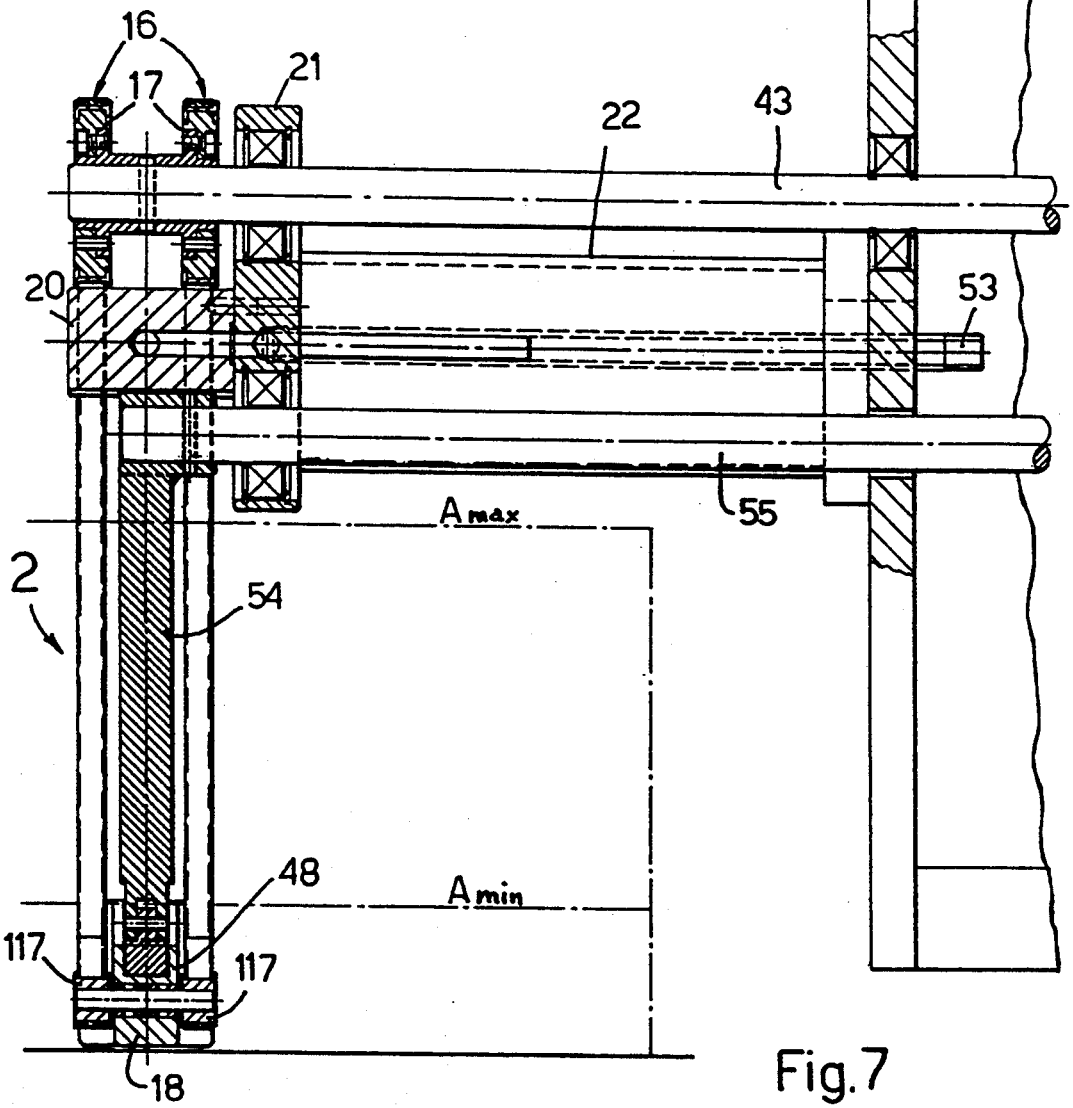

In the detail view of FIG. 4 it can be seen that the belts 16 are provided on the outer smooth surface, with small equally-spaced protrusions 116 in line with each other, constituting a step of an extent which is equal to or slightly smaller than the thickness of a box A.

Figures 12, 13, 14, 15:
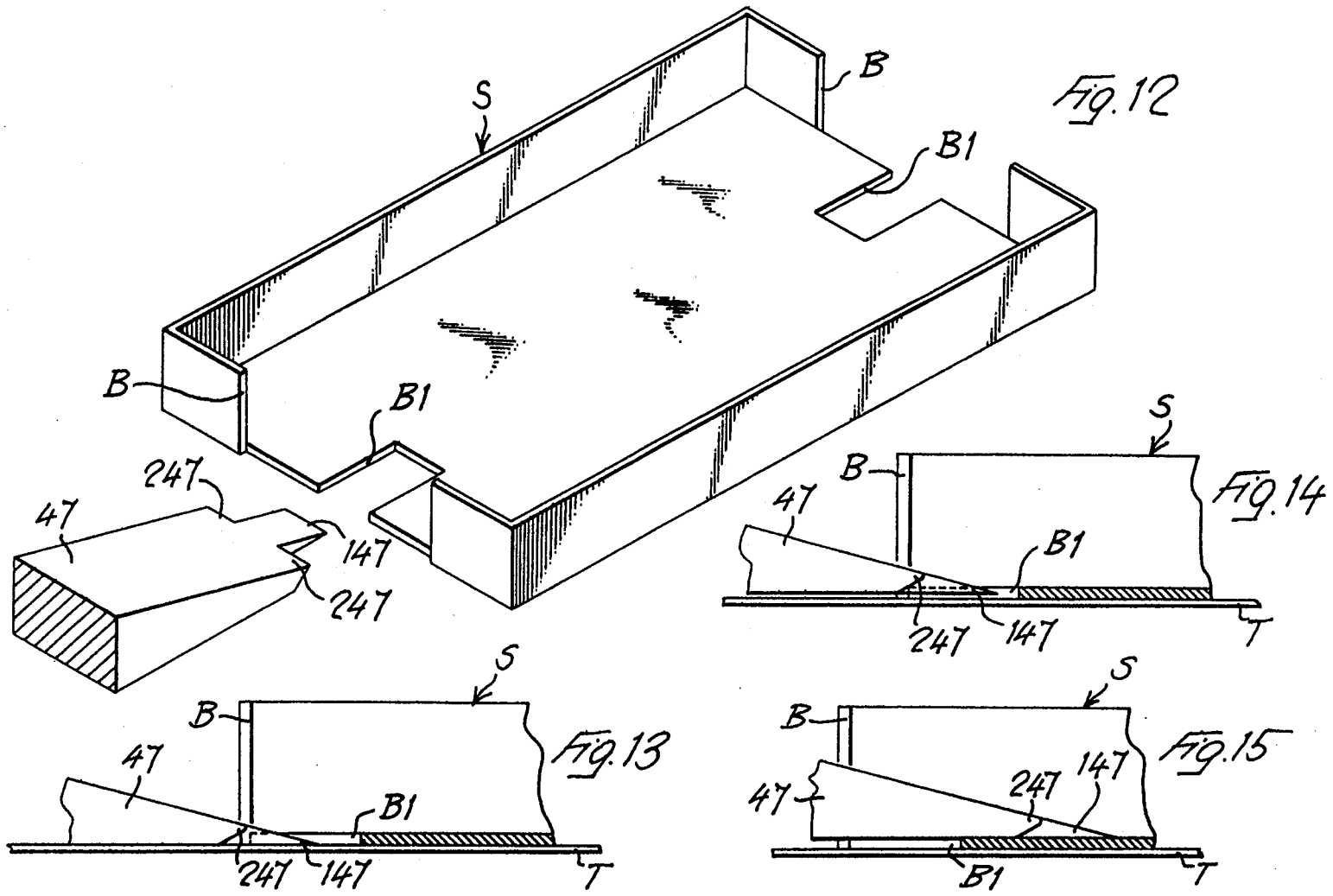
FIG. 12 shows a type of case containing the boxes, which is used for operation with the pick up means for the boxes used in the embodiment shown in FIG. 3.
FIGS. 13, 14 and 15 show as many operational phases of a detail of the pick up means used in the embodiment shown in FIG. 3.

Preferring to FIGS. 3-5-6 and 12 to 15, it can be appreciated that the shoe 18 has secured overhangingly to its front end a wedge member 47, spaced from the conveyor T, similarly to said shoe, to an extent which is equal to or slightly larger than the thickness of the bottom wall of the case S containing the horizontal stacks of boxes A. The front openings B of said cases are of such a width as to be traversed by the belts 16 and to define the front walls of said cases over the entire height and they extend to define as well a portion B1 of the bottom wall of said cases, but with a width which is smaller than that of the vertical sides of the front opening B, and which is slightly larger than the width of the protruding front end 147 of said wedge 47, the front edge of which has a slightly rounded corner. The leading boxes in the stack disposed horizontally in the case S move onto the end 147 of the wedge 47 and clear the side edges of the small bottom opening B1 in the bottom wall of said case, so that the rear opposite tips 247 of said wedge will then co-operate with said edges, said tips being characterized by a front, sloping, chamfered outline as seen in FIG. 13, whereby said tips positively get over said side edges of the opening in the bottom wall of the case, so as to keep the bottom wall of said case surely under the wedge 47 and the shoe 18. When the rear tips 247 co-operate with the edges of the bottom opening B1 in the case S, the front end 147 of said wedge is still in said bottom opening, so that at the end thereof said front end 147 is certainly in the ideal condition to get over the bottom wall of the case S and under the horizontal stack of boxes A arranged therein.

It is to be understood that, as shown by way of example in FIG. 2, at the pre-feed station 1, the stack of boxes A may be otherwise brought into direct engagement with the conveyor T and with lateral containing guides or conveyors T1, said stack being suitably held on such means by the action of gravity as a result of a suitable longitudinal inclination of the conveyors, and/or by the action of a counterweight P disposed on the bottom conveyor T and acting on the rear side of the stack. In this instance, the conveyor T is formed by parallel belts having disposed therebetween the wedge 47 which may be constructed in a simplified form, with the front end disposed under the conveyor T.

Upon mounting on the wedge 47, the stacked boxes A become staggered concerning their top portions and the leading box will become engaged against the lower initial portion of the rectilinear flights of the belts 16 whose protrusions 116 will lift said box and insert it, under the control of the roller tracks 36, into a gripping strip 12 before the latter leaves the return pulley 13 of the conveyor 3. The box immediately successive to the one which has become engaged with the belts 16, engages with the lower stop portion 136 of the roller tracks 36, which holds said box in its lower position because stop portion 136 is spaced from the plain surface of said belts by an extent smaller than the double of the thickness of the boxes A to be fed. Moreover, in order to avoid that the rubbing of the belts 16 against the box successive to the one which has been lifted by the protrusions 116 (which may also lift said successive box or open it) a slide member 48 is provided on the shoe 18 movable longitudinally along said shoe under the control of lateral guides 49 which are used as well to support the lower end of the guides 216 which act on the active flights of the belts 16 (FIGS. 3-6). The slide member 48 is provided, on its side facing the stack of boxes in the station 1, with holes 50 communicating, through a flexible duct 51, with conduits 52 in the parts 19-20-21 (FIGS. 3-9), said conduits communicating, in turn, through a conduit 53 co-axial with the tubular support 22, with a suction source (not shown). The box following the one which has been lifted by the belts 16, is retained by the suction exerted through the holes 50 in the slide member 48 which at due time is moved to a small extent in a direction opposite to the direction of advance of the conveyor T, so as to separate the boxes from the belts 16. At due time, before the successive pair of protrusions 116 on the belt 16 reaches the wedge 47, the slide member 48 is returned to its retracted rest condition, whereby the boxes are returned into engagement with said belts 16. On completion of the return stroke, the suction through the holes 50 is temporarily de-activated.

The actuation of the slide member 48, in phase with the assembly 16-3 (FIGS. 3-7-8-11), is effected, for example, by a lever 54 which, via its lower end, co-operates swingably with an intermediate upper seat in said slide member and which is pivoted on a shaft 55 which is rotatably supported by the parts 21-123 and is keyed to a lever 56 which, via its end roller 57, co-operates with the contour of a cam 58 keyed on the shaft 39.

Figure 16:
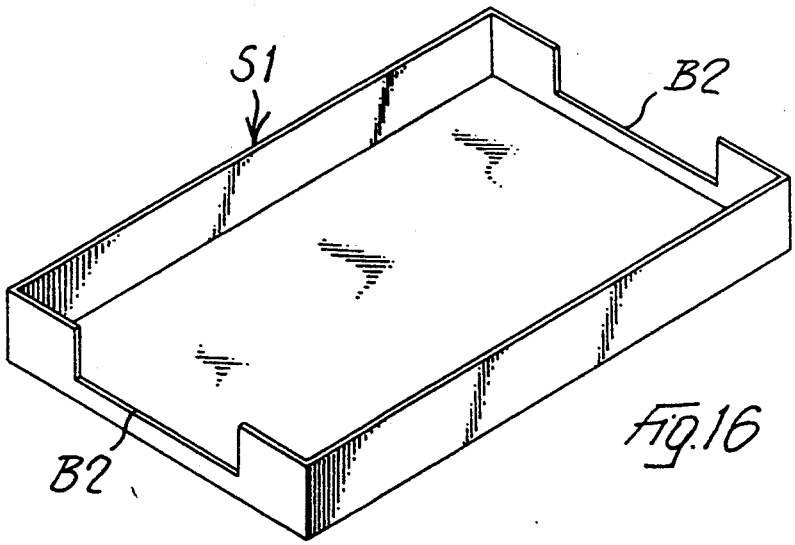
FIG. 16 shows a modified embodiment of the case containing the boxes.
Figure 17:
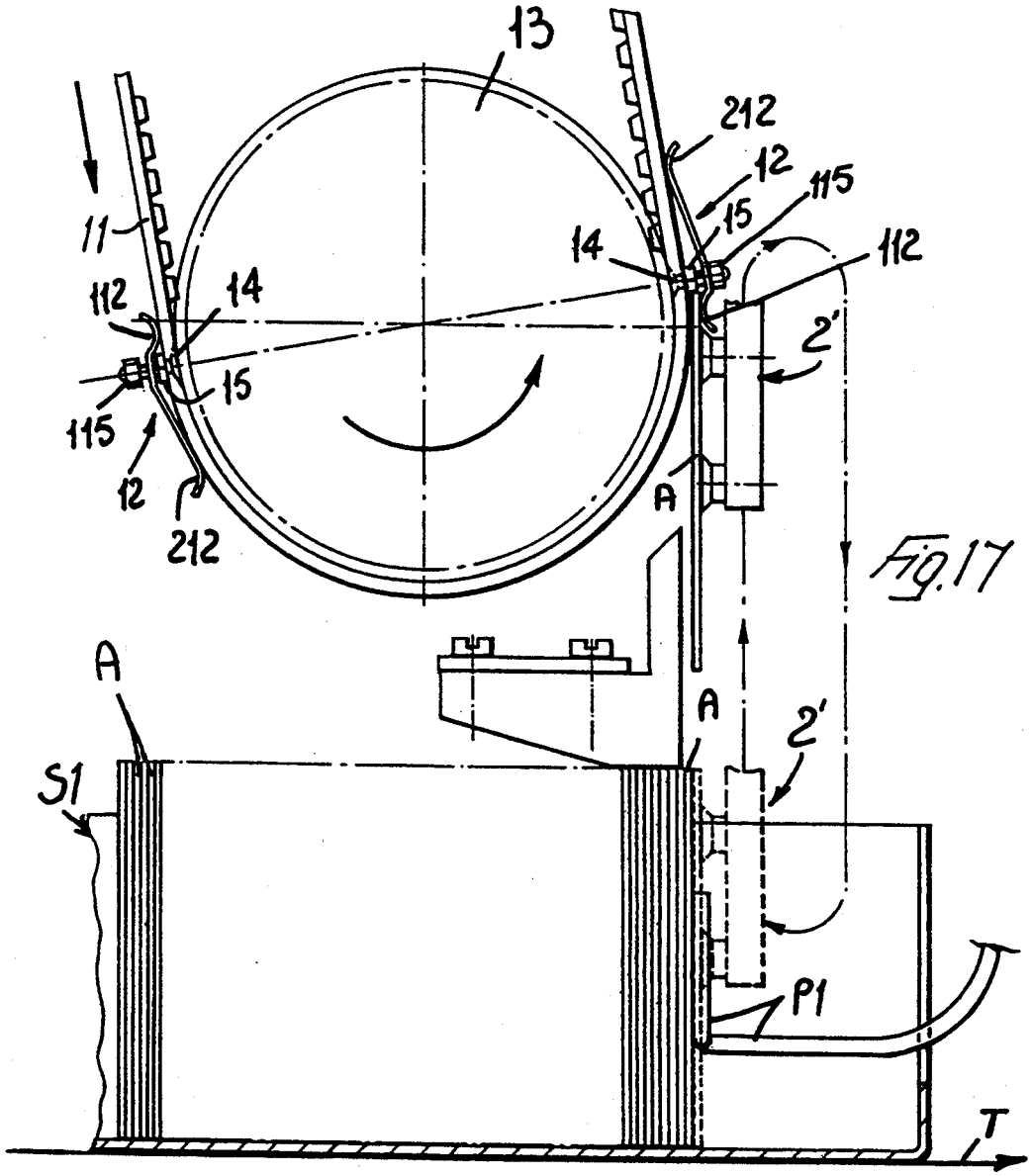
FIG. 17 shows a detail of a modified embodiment of the pick up means for the boxes, suitable for operating with a case of the type shown in FIG. 16.

In FIGS. 16 and 17 there is illustrated a further embodiment of the pick up means for the boxes A. The said boxes A are arranged in a package inside a case S1 which presnets opening B2 provided centrally at its smaller vertical sides so as to allow the passage through the length of the case of a suitable fixed stop member P1. When the case S1, loades with the boxes A, is moved by the conveyor T in the direction of the arrow, the first box A in the row is picked up the suction pick up means 2' of any conventional type, which are reciprocatingly movable up and down, and is inserted under the end 112 of a gripper 12.

We claim:

1. An apparatus for feeding pre-formed boxes to a feed store of a machine comprising:

a pre-feed station where the boxes are provided in a stacked condition;

a conveying means for cyclically receiving one box at a time from said pre-feed station, for retaining the single box thereon without deformation and interference from other boxes, and for conveying the retained box individually to the store;

an extracting means for extracting boxes singly from said pre-feed station and for transferring the box to said conveying means in phase with the operation of said conveying means; and a discharge means for extracting the retained boxes from said conveying means at the store so that the boxes fall one by one into the store in a desired stacked position.

2. An apparatus for feeding boxes as claimed in claim 1 and further including a monitoring means for monitoring a speed of said conveying means and associated said extracting means, a load level of the boxes in the store, and a frequency of withdrawal of boxes from the store, and for controlling the speed of said conveying means and said extracting means proportional to the frequency of the withdrawal of boxes from the store so that the load level in the store remains constant or within limits ensuring a best operation of a means which extracts the boxes from the store and inserts the boxes into the machine.

3. An apparatus for feeding boxes as claimed in claim 2 wherein said conveying means includes a flexible belt having an outer face and grippers equally spaced along said outer face, an opening means for opening said grippers at least partially as a box is received from said extracting means at said pre-feed station and extracted therefrom at the store and for closing said grippers between said pre-feed station and the store.

4. An apparatus for feeding boxes as claimed in claim 3 wherein each said gripper includes a strip having an intermediate portion, a rounded holding end, and an other end, an attaching means for attaching said intermediate portion of said strip to said belt such that at least said holding end of said strip is free to oscillate transversely of the belt and to receive the box between said holding end and said belt, and elastic means for pressing the holding end towards said belt by reaction against said belt such that when said belt follows a rectilinear path and a curved path of large radius said holding end is pressed against said belt and retains an interposed box firmly; and wherein said conveying means includes two small diameter pulleys having a much smaller radius than the large radius, one being located at said pre-feed station and one at the store such that when the belt is passed around said small diameter pulleys said holding end is held at least to a lower degree against said belt to facilitate respective insertion and extraction of the box at the respective pre-feed station and store.

5. An apparatus for feeding boxes as claimed in claim 4 wherein each said strip of said grippers is flexible to provide said elastic means, said intermediate portion is bent with a concave part facing said belt, and said other end is also rounded;

wherein said attaching means attaches said intermediate portion to said belt with a clearance between said belt and said intermediate portion.

6. An apparatus for feeding boxes as claimed in claim 5 wherein said attaching means of each said gripper is spaced closer to said holding end than to the other end, a longer distance to the other end from said attaching means helping to ensure the lower degree of holding by said holding end and a shorter distance to said holding end causing said attaching means additionally to act as a limiting means for limiting an extent of the box received under said holding end.

7. An apparatus for feeding boxes as claimed in claim 4 wherein said holding ends of said grippers are oriented rearwardly of a direction of travel of said conveying means;

wherein said extracting means transfers the box to said grippers in the direction of travel and with a variable speed motion; and wherein said discharge means includes stationary parts against which free front portions of the boxes held by said grippers engage to cause the boxes to be pulled from said grippers and fall by gravity into the store.

8. An apparatus for feeding boxes as claimed in claim 7 wherein said extracting means includes a pair of parallel pick-up belts which carry the boxes to the grippers and which have rectilinear, mutually co-planar guided flights, said belts having an active surface and protrusion spaced along said active surface having a thickness which is no greater than a thickness of the boxes, a stacking means for guiding and keeping a stack of boxes adjacent said flights of said pick-up belts so that said protrusions engage with an edge of a leading box of the stack and move the leading box with said pick-up belts, a moving means for moving said pick-up belts with a motion derived from said conveying means and having an intermediary means for generating the variable speed motion, rectilinear roller tracks which are parallel and opposite to said pick-up belts and located immediately downstream of said stacking means so that when said protrusions on said pick-up belts engage the leading box, the leading box is driven between the roller tracks and pick-up belts and thus moved by said pick-up belts to an awaiting said gripper, a stop means located between said roller tracks and said stacking means for preventing a movement of a successive box in the stack when the leading box is engaged by said protrusions, and a slide means for moving the successive box away from said pick-up belts after removal of the leading box to prevent inadvertent engagement with said pick-up belts and for returning the successive box as the new leading box in phase with the approach of said protrusions on said pick-up belts.

9. An apparatus for feeding boxes as claimed in claim 8 wherein said pick-up belts are toothed and move around a pair of upper toothed pulleys having a carrying shaft; and wherein said intermediary means includes a speed multiplier connected to said conveying means and having an output shaft, an eccentric toothed pulley keyed eccentrically to said output shaft, a connecting pulley keyed to said carrying shaft of said upper pulleys for said pick-up belts, and a toothed belt and associated jockey-pulley means for connecting said eccentric pulley with said connecting pulley.

10. An apparatus for feeding boxes as claimed in claim 9 wherein said slide means includes a cam mounted on said output shaft of said speed multiplier, a first lever having a first end which follows said cam and a second end, a pivotable shaft to which said second end of said first lever is attached so that motion of said first end of said lever causes an oscillatory motion of said pivotable shaft, a second lever keyed to said pivotable shaft, and a slide member which is moved by movement of said second lever and engages the successive box.

11. An apparatus for feeding boxes as claimed in claim 10 and further including a variator gearmotor, a positive drive device for connecting said gearmotor to said conveying means for driving said conveyor means, a universal joint which connects said positive drive device to an input for said speed multiplier.

12. An apparatus for feeding boxes as claimed in claim 11 wherein said positive drive device includes an output shaft connected to said gearmotor and to said small diameter pulley of said conveying means, a slide movable relative to said stacking means to which said gearmotor, said output shaft and said roller tracks are all attached, and an adjustment means for adjusting a position of said slide to accommodate different sizes of boxes in said stacking means.

13. An apparatus for feeding boxes as claimed in claim 12 wherein said extracting means further includes a supporting upright having a lower end, a shoe secured in cantilever fashion to said lower end, said shoe having sides, a front portion, and shoe guides extending upwardly from said sides such that said shoe and shoe guides form a guide channel for said slide, a pair of lower pulleys for said pick-up belts rotatably mounted to said front portion of said shoe, lateral guides for said roller pick-up belts adjacent the flights thereof supported by said shoe guides, and wherein said slide means further includes an internal duct in said supporting upright through which suction from a source is conducted, a hose which is connected to said internal duct, and holes in a face of said slide facing the successive box for holding the successive box to said slide member.

14. An apparatus for feeding boxes as claimed in claim 13 wherein said extracting means further includes a wedge secured to the front portion of said shoe, said wedge having a pointed end which is located at a lowest point of the stack of the boxes so that the boxes move onto said wedge and are staggered thereby for easy removal.

15. An apparatus for feeding boxes as claimed in claim 14 wherein said pre-feed station includes horizontal stacks of the boxes in cases, said cases having front and back vertical openings and bottom horizontal openings extending inwardly from said vertical openings and having a width smaller than that of said vertical openings and of said wedge and a length, a conveyor for conveying said cases to said extracting means, and wherein said wedge is spaced above said conveyor in order to allow bottoms of the cases to pass therebeneath as said wedge passes through said vertical opening, said pointed end of said wedge including a leading tip having a front edge which is rounded, and two rear lateral tips disposed on respective sides of said leading tip and rearwardly thereof relative to a direction of movement of said conveyor by a distance less than the length of said bottom horizontal openings, said rear lateral tips having a front edge inclined rearwardly to facilitate movement of the bottoms of the cases beneath said leading tip.

16. An apparatus for feeding boxes as claimed in claim 3 wherein said conveying means further includes a plurality of pulleys making up a composite path for said flexible belt and a helical means for imparting a helical displacement to said flexible belt so that said grippers are always facing away from said pulleys.

17. A method for feeding pre-formed boxes to a feed store of a machine comprising the steps of:

extracting boxes singly from a pre-feed station where the boxes are provided in a stacked condition;

operating a conveying means for conveying the boxes from the pre-feed station to the store;

transferring each extracted single box to the conveying means individually and in phase with the operation of the conveying means, including the steps of cyclically receiving on the conveyor means one extracted box at a time from the pre-feed station and retaining the single box on the conveying means by attachment to the conveying means without deformation and away from interference any with other boxes;

extracting the retained boxes from the conveying means at the store so that the boxes fall one by one into the store in a desired stacked position;

monitoring a speed of the conveying means and the associated said extracting and transferring steps, a load level of the boxes in the store, and a frequency of withdrawal of boxes from the store; and controlling the speed of the conveying means and said extracting and transferring steps proportional to the frequency of the withdrawal of boxes from the store so that the load level in the store remains substantially constant or within limits ensuring a best operation of a means which extracts the boxes from the store and inserts the boxes into the machine.

18. A method for feeding boxes as claimed in claim 17 and further comprising the step of feeding stacks of boxes to the pre-feed station; and wherein said controlling step includes the step of controlling the speed of the conveying means to be directly proportional to a frequency of operation of the means which extracts the boxes from the store.

19. A method for feeding boxes as claimed in claim 18 and further including the step of separating with a physical barrier the pre-feed station from the store and providing a pathway through the barrier for the conveying means between the pre-feed station and the store.

* * * * *

UNITED STATES PATENT AND TRADEMARK OFFICE

CERTIFICATE OF CORRECTION

PATENT NO. : 5,405,239

DATED : April 11, 1995

INVENTOR(S) : CALZOLARI et al.

It is certified that error appears in the above-indentified patent and that said Letters Patent is hereby corrected as shown below:

On the title page item [75], add to the list of inventors before

"; all of Italy" the following inventor:

--, Gianni Cavallari, Bologna--.

Signed and Sealed this

Eighteenth Day of July, 1995

*Attest:*

Bruce Lehman

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,405,239

DATED : April 11, 1995

INVENTOR(S) : CALZOLARI et al.

It is certified that error appears in the above-indentified patent and that said Letters Patent is hereby corrected as shown below:

On the cover page Item [75]

change "Guiseppe" to --Giuseppe--; and change "obici Valter" to --Valter Obici--.

Signed and Sealed this

Twenty-ninth Day of August, 1995

Bruce Lehman

*Attest:*

BRUCE LEHMAN

*Attesting Officer*

*Commissioner of Patents and Trademarks*